US005407367A

United States Patent [19]

Robertson

[11] Patent Number: 5,407,367

[45] Date of Patent: Apr. 18, 1995

[54] BARRIER TERMINAL STRIP ASSEMBLY

[75] Inventor: Gary Robertson, Gilford, N.H.

[73] Assignee: Vernitron Corporation, New York, N.Y.

[21] Appl. No.: 127,143

[22] Filed: Sep. 27, 1993

[51] Int. Cl.[6] ..... H01R 9/26

[52] U.S. Cl. ..... 439/716; 439/715

[58] Field of Search ..... 439/709, 712, 715, 716, 439/717, 718

[56] References Cited

U.S. PATENT DOCUMENTS

| | | | |
|---|---|---|---|
| 3,018,464 | 1/1962 | Mrenna et al. | 439/716 |
| 4,239,324 | 12/1980 | Stenz | 439/716 |
| 4,425,018 | 1/1984 | Stenz | 439/716 |
| 4,795,376 | 1/1989 | Franke et al. | 439/715 |

FOREIGN PATENT DOCUMENTS

| | | | |
|---|---|---|---|
| 3723288 | 10/1988 | Germany | 439/715 |

*Primary Examiner*—Larry I. Schwartz
*Assistant Examiner*—Hien D. Vu
*Attorney, Agent, or Firm*—Scully, Scott, Murphy & Presser

[57] ABSTRACT

A dual level terminal assembly for use in connecting closely packed leads to a circuit board. The assembly includes an elongated base support and a lower barrier terminal strip mounted on a from portion of the support, and an upper barrier terminal strip mounted on a rear portion of the support which faces the from portion and which is at a higher level that the front portion.

14 Claims, 2 Drawing Sheets

BARRIER TERMINAL STRIP ASSEMBLY

BACKGROUND OF THE INVENTION

1. Field of Invention

This invention relates generally to the field of barrier terminal strips and more of the type having wire to wire or wire to printed circuit board interconnection and more specifically to a barrier terminal strip assembly having a support for mounting an upper barrier terminal strip above a lower barrier terminal strip.

2. Description of the Prior Art

The prior art barrier terminal strips includes an elongated terminal strip having a bottom wall and a series of spaced screw activated wire clamps with bayonet-type terminals, which project from the bottom or back wall for insertion into corresponding holes in a printed circuit board.

Recent art has developed a two piece disengageable barrier terminal strip of a screw clamp terminal strip plug and a mating header having a series of terminal pins inserted into a conforming insulator. When engaged, the two parts perform as a barrier terminal strip, however, they must be disengaged to facilitate installation or replacement.

One problem with this prior art terminal assembly is that it is difficult and on occasion impossible to connect the appropriately sized electrical lead to each of the screw clamps on the terminal strip, in the space allotted for the terminal strip on a printed circuit board. To facilitate the saturation of wires within the board space allotted, the terminals are positioned at different heights or levels above the board by assemblies consisting of multi level terminal strips or headers fabricated from a single piece with a stepped height base or two discreet bases of different height with appropriate length terminals for insertion into a printed circuit board.

SUMMARY OF THE INVENTION

According to the present invention, a multiple level terminal assembly is provided, which comprises an elongated base support, a barrier terminal strip mounted on one level of the base support, and another barrier terminal strip mounted on an upper level of the base support.

By using a multiple level terminal assembly, a substantially greater number of electrical terminals are available for a space allotted on a printed circuit board for a single barrier terminal strip.

It is therefore a principal object of the present invention to increase the number of electric terminals available on a printed circuit board, without increasing the linear space available on the board.

Another object of the present invention, is to minimize the difficulty of connecting electrical leads to each of the terminals, of a pair of parallel adjacent barrier terminal strips.

Still another object of the present invention, is to provide a multiple level barrier terminal strip assembly, for connecting electrical leads on a printed circuit board using two standard terminal block strip assemblies prepositioned in 3 axes via a securely fastened docking station.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENT

Figure 1:
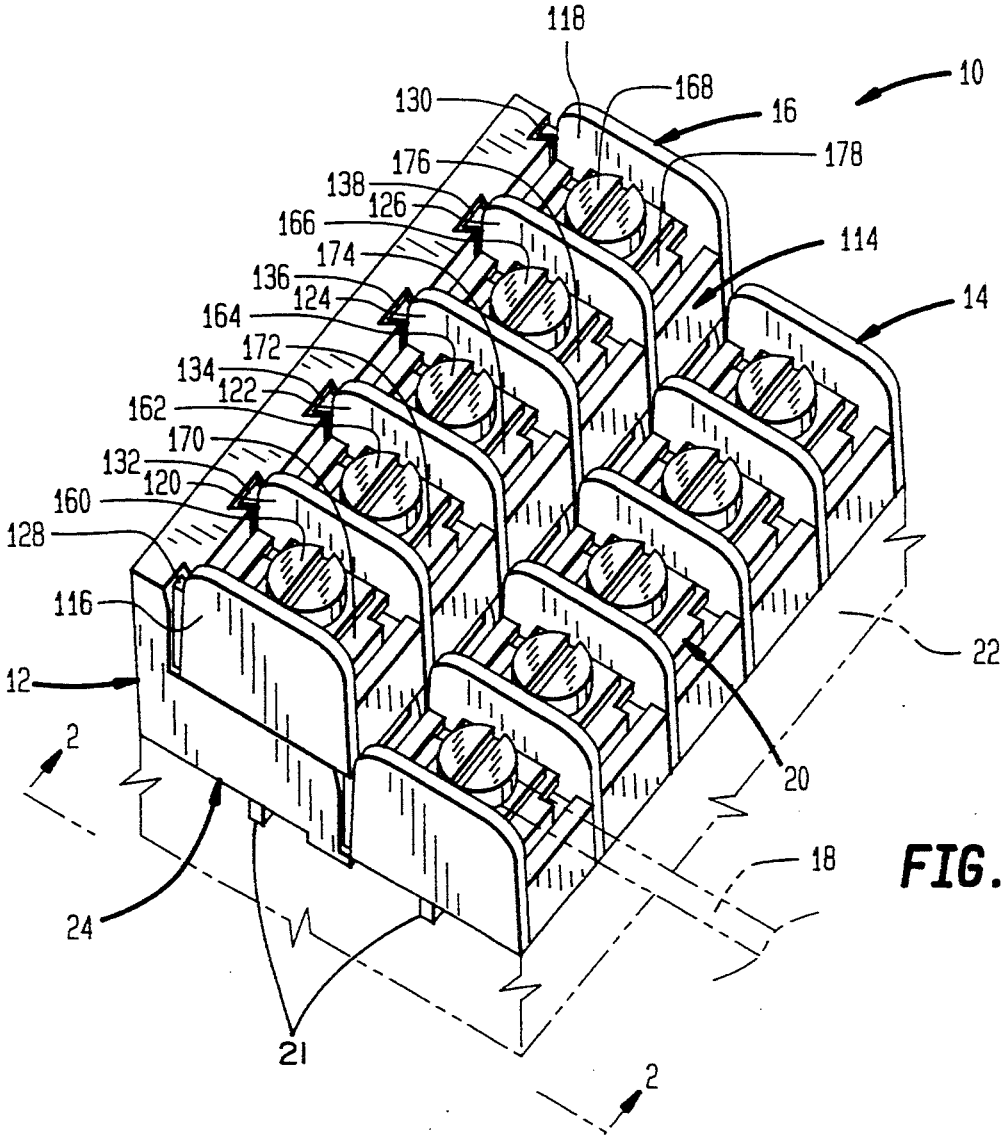
FIG. 1 is a perspective view of a barrier terminal strip assembly according to the present invention.
Figure 2:
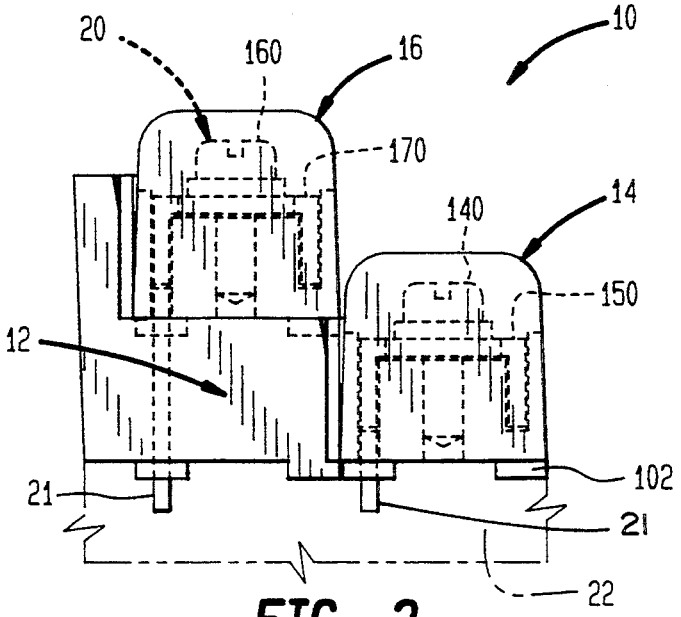
FIG. 2 is an elevational view taken along line 2—2 of FIG. 1.

Referring now to the drawings wherein like reference characters designate like or corresponding parts throughout, there is illustrated in FIGS. 1, 2, 3 and 4, a barrier terminal strip assembly or a docking station generally designated as reference numeral 10 having a base or support 12, an upper barrier terminal strip 16, and a lower barrier terminal strip 14. The terminal strips 14 and 16 connect a plurality of wires or leads 18 to a printed circuit board 22. The terminal strips 14, 16, contain a plurality of connectors or conductors 20 each of which have protruding terminal ends 21. The terminal ends 21 are inserted or placed in the printed circuit board 22. In this embodiment, the material of the support 12, and the barrier terminal strips 14, 16 are made of a dielectric material such as a conventional thermoplastic. The purpose of the assembly 10 is to permit connection of the leads 18 to each conductor 20 in a respective one of the barrier terminal strips 14, 16, and to minimize the difficulty of making such connections.

Figure 3:
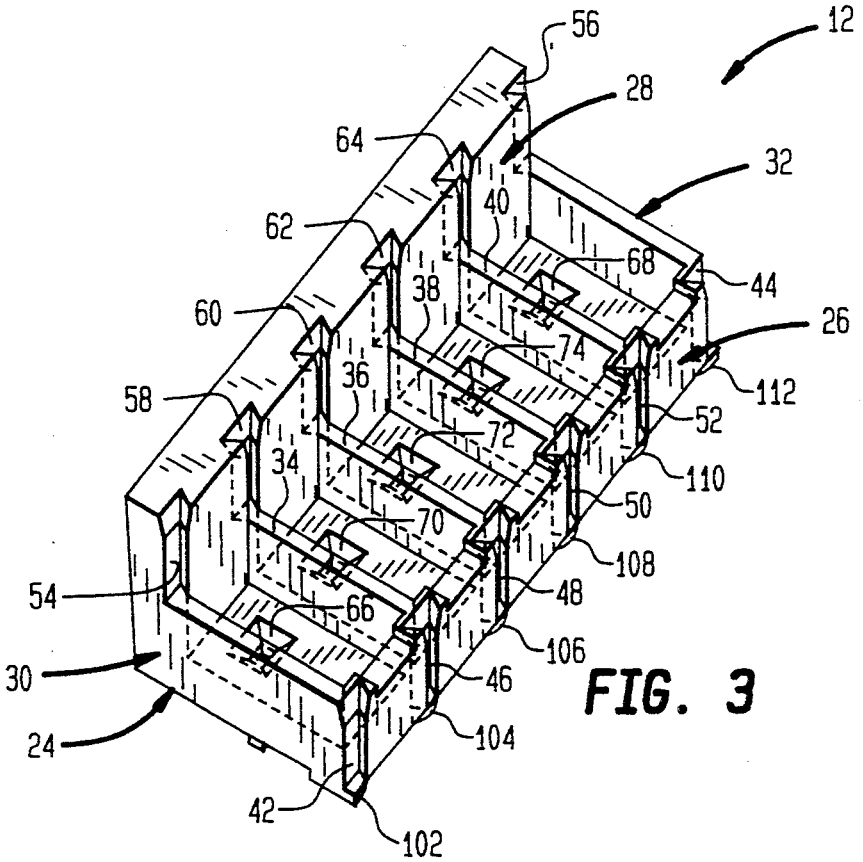
FIG. 3 is a perspective view of a portion of the barrier terminal strip assembly of FIG. 1.

As shown in FIG. 3, the support 12 includes a bottom wall 24, a front wall 26, a rear wall 28, a left end wall 30, a right end wall 32, and four intermediate walls 34, 36, 38, and 40. The front wall 26 has a left end dovetail half mortise or groove 42, a right end dovetail half mortise 44, and four intermediate dovetail full mortises or grooves 46, 48, 50, 52.

The rear wall 28 of the support 12 also has a left end dovetail half mortise 54, a right end dovetail half mortise 56, and four intermediate dovetail full mortises or grooves 58, 60, 62, 64. The bottom wall 24 has a left end hole or passage 66 a right end hole 68, and three intermediate holes 70, 72, 74. The holes 66, 68, 70, 72, 74 are respectively disposed about midway between the respective walls 30, 34 and 34, 36 and 36,38 and 40,32.

Figure 4:
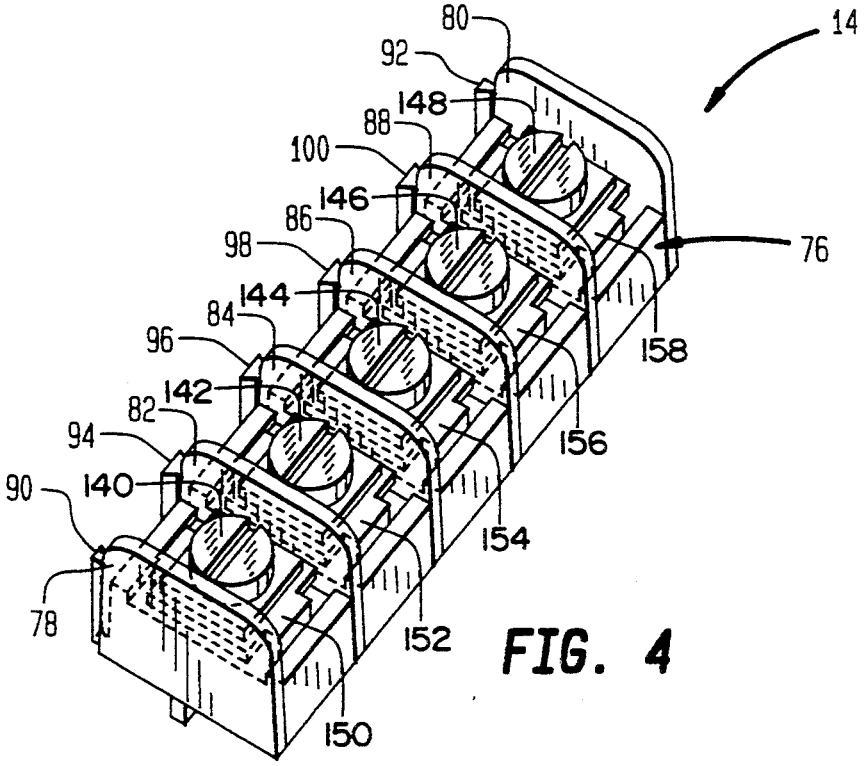
FIG. 4 is a perspective view of another portion of the barrier terminal strip assembly of FIG. 1.

As shown in FIG. 4, the lower barrier terminal strip 14 includes an elongated bottom wall 76, a left end projecting rib 78, a right end projecting rib 80, and four intermediate projecting ribs 82, 84, 86, 88. The ribs 78, 80 have respective dovetail half tenons or half T-shaped edged portions 90, 92. The intermediate ribs 82, 84, 86, 88 have respective intermediate dovetail full tenons or T-shaped edge portions 94, 96, 98, 100.

The bottom wall 24 of the support. 12 has respective bottom stops 102, 104, 106, 108, 110, 112 for stopping the respective tenons 90, 94, 96, 98, 100, 92, of the lower barrier terminal strip 14.

As shown in FIG. 1, the upper barrier terminal strip 16 has a construction which is nearly identical to the construction of the lower barrier strip 14. The upper barrier terminal strip has a front wall 114, a left end rib 1 ]6, a right end rib 118, a four intermediate ribs 120, 122, 124, 126. The ribs 116, 118 respectively have half tenons 128, 130. Intermediate ribs 120, 122, 124, 126 respectively have full tenons 132, 134, 136, 138.

The conductor subassembly 20 includes lower screws 140, 142, 144, 146, 148, which respectively have L-shaped, washer-like, spring steel plates or sheets 150, 152, 154, 156, 158. The screws 140, 142, 144, 146, 148 [lave respective threaded holes (not shown) in the bottom wall 76. The conductor subassembly 20 also includes upper screws 160, 162, 164, 166, 168 which have respective upper plates 170, 172, 174, 176, 178. The upper screws 160, 162, 164, 166, 168 have respective threaded holes (not shown) in the wall 114. Upper plates 170, 172, 174, 176, 178 have respective vertical legs with terminal ends 21 which pass through the respective holes 66, 68, 70, 72, 74. The tips of the ends 21 of the upper plates 170, 172, 174, 176, 178 are about the same elevation, when vertically disposed, as the tip of the ends 21 of the lower plates 150, 152, 154, 156, 158.

In assembling the barrier terminal strip assembly, the lower barrier terminal strip 14 is connected to the support 12 by inserting the tenons 90, 94, 96, 98, 100, 92 into the respective mortises 42, 46, 48, 50, 52, 44; and then by pressing down on the lower barrier terminal strip 14 until the tenons 90, 94, 96, 98, 100, 92 hit or contact the stops 102, 104, 106, 108, 110, 112. The upper barrier terminal strip 16 is connected to the support 12 by inserting the tenons 128, 130, 132, 134, 136, 138 into the mortises 54, 56, 58, 60, 62, 64; and then by pressing down on upper barrier terminal strip 16 until its bottom wall 114 hits or contacts ribs 78,82, 84, 86, 88, 80, or tenons 90, 94, 96, 98, 100, 92, thereby locking the lower barrier terminal strip to the support 12.

The advantages of assembly 10 are:

a. Assembly 10 minimizes the difficulty of connecting leads 18 to each of the terminals of prior an barrier terminal strips;

b. Assembly 10 provides a multilevel terminal assembly for ease of connection leads 18 to each of the terminals 20, 21.

c. Assembly 10 can be increased in size by adding one or more barrier terminal strips 14 or 16 to a support 12, in a transverse direction.

It should also be understood that although the barrier terminal strips 14 and 16 have been illustrated as each having five terminals, they may have substantially more or less. Moreover, if desired, either or all of the barrier terminal strips may be longer than the support and overhang the same at either or both ends of the support. In addition, the multiple layers may be greater than two. It is also understood that the mortise and dovetail tenon locations may be reversed between the barrier terminal strip and the support.

It should be understood that the foregoing relates to a limited number of preferred embodiments of the invention which have been by way of and that it is intended to cover all changes and modifications of the examples of the invention herein chosen for the purpose of the disclosure, which do not constitute departures from the spirit and scope of the invention.

What is claimed:

1. A barrier terminal strip assembly comprising:

an elongated base support;

a lower separate barrier terminal strip mounted on a front portion of said base support and having conductors for connecting leads to a circuit board;

an upper separate barrier terminal strip mounted on a higher rear portion of said base support and having conductors for connecting leads to said circuit board; and coupling means positioned on said front and higher rear portions of said elongated base support for releasably mounting each of said lower and upper terminal barrier strips to said base support.

2. A barrier terminal strip assembly as claimed in claim 1, wherein said base support has a low level front wall and has a high level rear wall extending vertically higher than said front wall and has at least one wall fixedly connecting said rear wall to said front wall.

3. A barrier terminal strip assembly as claimed in claim 1, wherein said front portion and said higher rear portion of said base support each have female coupling means integral with said front wall and said rear wall, respectively, for connecting said respective barrier terminal strips thereto.

4. A barrier terminal strip assembly as claimed in claim 3, wherein said lower barrier strip and said upper barrier strip each has complementary male coupling means for mating with said respective female coupling means.

5. A barrier terminal strip assembly as claimed in claim 4, wherein said female coupling means comprises a vertical dovetail mortise and said complementary male coupling means comprises a vertical dovetail tenon.

6. A barrier terminal strip assembly as claimed in claim 1, wherein said lower barrier terminal strip conductors and said upper barrier terminal strip conductors each have an L-shaped plate with a vertical leg and a protruding terminal end portion for insertion in said circuit board.

7. A barrier terminal strip assembly as claimed in claim 6, wherein said protruding terminal end portions each have respective equal tip portions extending into said circuit board.

8. A barrier terminal strip assembly as claimed in claim 6 wherein said lower barrier terminal strip and said upper barrier terminal strip are substantially identical in construction.

9. A barrier terminal strip assembly as claimed in claim 6, wherein said L-shaped plates each have a screw which is threaded into a respective hole in its adjacent strip.

10. A barrier terminal strip assembly as claimed in claim 4, wherein said base support has a low level front wall and a high level rear wall extending vertically higher than said front wall and has at least one wall fixedly connecting said rear wall to said front wall.

11. A barrier terminal strip assembly as claimed in claim 4, wherein said complementary male coupling means are integral with ribs separating each conductor.

12. A barrier terminal strip assembly as claimed in claim 1, wherein said front portion and said-higher rear portion of said base support each have male coupling means integral with said front wall and said rear wall, respectively, for connecting said respective barrier terminal strips thereto.

13. A barrier terminal strip assembly as claimed in claim 12, wherein said lower barrier strip and said-upper barrier strip each have complementary female coupling means for mating with said respective male coupling means.

14. A barrier terminal strip assembly as claimed in claim 13, wherein said male coupling means comprises a vertical dovetail mortise and said complementary female coupling means comprises a vertical dovetail tenon.

* * * * *

UNITED STATES PATENT AND TRADEMARK OFFICE

CERTIFICATE OF CORRECTION

PATENT NO. : 5,407,367

DATED : April 18, 1995

INVENTOR(S) : Gary Robertson

It is certified that error appears in the above-indentified patent and that said Letters Patent is hereby corrected as shown below:

In the Abstract, lines 4 & 6: "from" should read --front--

Column 2, line 59: after "support" delete --.--

Column 2, line 67: "1 ]6," should read --116,--

Column 3, line 7: "[lave" should read --have--

Column 3, line 36: "an" should read --art--

Signed and Sealed this

Twenty-seventh Day of February, 1996

Bruce Lehman

*Attest:*

BRUCE LEHMAN

*Attesting Officer*

*Commissioner of Patents and Trademarks*